US007602359B2

(12) United States Patent
Aoki

(10) Patent No.: US 7,602,359 B2
(45) Date of Patent: Oct. 13, 2009

(54) IMAGE SIGNAL CORRECTING METHOD, CORRECTING CIRCUIT, ELECTRO-OPTICAL DEVICE, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1019 days.

(21) Appl. No.: 11/041,259

(22) Filed: Jan. 25, 2005

(65) Prior Publication Data

US 2005/0219161 A1 Oct. 6, 2005

(30) Foreign Application Priority Data

Feb. 2, 2004 (JP) ..... 2004-026020

(51) Int. Cl.
*G09G 3/36* (2006.01)

(52) U.S. Cl. ..... 345/87; 345/98; 345/103

(58) Field of Classification Search ..... 345/78, 345/87, 98, 103
See application file for complete search history.

(56) References Cited

U.S. PATENT DOCUMENTS 6,329,980 B1 12/2001 Uehara et al.
2002/0005858 A1* 1/2002 Aoki ..... 345/618

FOREIGN PATENT DOCUMENTS

| | | |
|---|---|---|
| JP | A-09-304752 | 11/1997 |
| JP | A-11-231837 | 8/1999 |
| JP | A-2000-056726 | 2/2000 |
| JP | A-2000-322031 | 11/2000 |
| JP | A-2001-337641 | 12/2001 |
| JP | A-2002-149136 | 5/2002 |
| JP | A-2002-268604 | 9/2002 |

* cited by examiner

*Primary Examiner*—Amare Mengistu
*Assistant Examiner*—Joseph G Rodriguez
(74) *Attorney, Agent, or Firm*—Oliff & Berridge, PLC

(57) ABSTRACT

To reduce a block ghost in phase expansion driving in which image signals are sampled on a plurality of data lines divided into groups. In a phase expansion driving method, correction data Db is calculated by more largely weighting the average value of a gray-scale level changed from the block in the previous stage of a target block when the target block is selected than the average value of a gray-scale level changed from the block in two previous stages of the target block when the previous block is selected and by adding the average values. Then, the correction data Db is added to image data Vd1*d* to Vd6*d* of the pixels belonging to the target block, respectively, to obtain the corrected image data Vd1*e* to Vd6*e*. Subsequently, the corrected image data are converted into analog data, and their polarities are inverted to supply to image signal lines of an electro-optical panel.

11 Claims, 6 Drawing Sheets

IMAGE SIGNAL CORRECTING METHOD, CORRECTING CIRCUIT, ELECTRO-OPTICAL DEVICE, AND ELECTRONIC APPARATUS

BACKGROUND

Exemplary embodiments of the present invention relate to a technique of reducing or preventing the deterioration of display quality generated when a plurality of data lines divided into groups are driven.

The related art includes an electro-optical panel that performs display using the electro-optical variation of an electro-optical material, such as liquid crystal, that is applied to a light valve of a projector. That is, in this type of electro-optical panel, liquid crystal is interposed between a pair of substrates. As shown in FIG. 5, a plurality of scanning lines 112 and a plurality of data lines 114 are provided on one of the pair of substrates so as to be orthogonal to each other. In addition, a pair of thin film transistors (hereinafter, referred to as a 'TFT') 116 and a pixel electrode 118 is provided corresponding to each intersection of the scanning lines 112 and the data lines 114. A transparent counter electrode (common electrode) 108 to which a constant voltage LCcom is applied, is provided opposite to the pixel electrodes 118 on the other substrate, and for example, a TN type of liquid crystal 105 is interposed between both of the substrates. In this way, a liquid crystal capacitor composed of the pixel electrode 118, the counter electrode 108, and the liquid crystal 105 is formed for every pixel.

Further, although not shown in FIG. 5, alignment films are provided on surfaces of both the substrates facing each other with a liquid crystal layer interposed therebetween. A rubbing process is performed on the alignment films such that liquid crystal molecules can be continuously twisted at an angle of, for example, 90° in the lengthwise direction thereof between both the substrates. In addition, polarizers are respectively provided in the alignment direction on the other surfaces of the substrates opposite to each other.

Furthermore, in order to reduce or prevent the leakage of electric charges from the liquid crystal capacitor, a storage capacitor 119 is formed for every pixel. One end of the storage capacitor 119 is connected to the pixel electrode 118 (a drain of the TFT 116), and the other end thereof is connected to the ground having an electric potential Gnd, which is applied to all pixels in common. In the present exemplary embodiment, the other end of the storage capacitor 119 is connected to the electric potential Gnd, but may have a constant electric potential (for example, a voltage LCcom, a power supply voltage having a high potential of a driving circuit, or a power supply voltage having a low potential on the driving circuit).

When an effective voltage value of the liquid crystal capacitor is zero, light passing between the pixel electrodes 118 and the counter electrode 108 is optically rotated at an angle of about 90° according to the twisted liquid crystal molecules. On the other hand, when the effective voltage value is large, the liquid crystal molecules are inclined in the electric potential direction, resulting in the removal of the optical rotation. Therefore, for example, in a transmissive liquid crystal display device, in the case of a normally white mode in which polarizers whose polarizing axes are arranged orthogonal to each other along the alignment direction are respectively provided on the light incident side and the rear side opposite thereto, when the effective voltage value is zero, white display is performed since light passes through the polarizers (transmittance is high). On the other hand, when the effective voltage value is large, the amount of light passing through them is reduced, so that black display is performed (transmittance is low). Thus, when the scanning lines 112 are selected one by one to turn on the TFTs 116, the image signal having the voltage corresponding to the grayscale (or brightness) of the pixel can be applied to the pixel electrode 118 through the data line 114, and thus it is possible to control the effective voltage value of the liquid crystal capacitor for each pixel. This control enables predetermined display.

Of course, the projector to which the electro-optical panel is applied does not have a function to form an image in itself, but receives image data (or image signals) from a host apparatus, such as a personal computer or a television tuner, to form an image. Since the image data is supplied in the manner of horizontally and vertically scanning pixels arranged in a matrix, it is appropriate to drive the electro-optical panel used for the projector according to this manner. Therefore, a point-sequential driving method is employed for the electro-optical panel used for the projector as a driving method to supply image signals to the data lines 114. In the point-sequential driving method, the image data are converted into image signals suitable for driving liquid crystal, and the image signals are sampled and supplied to the respective data lines 114 in the period where one scanning line 112 is selected (one effective horizontal scanning period).

Further, in recent years, a high-definition display device has strongly been demanded. The high definition can be addressed or achieved by increasing the number of scanning lines 12 and the number of data lines 114. However, in this case, one horizontal scanning period is shortened with an increase in the number of scanning lines 112, and in a point-sequential method, sampling time on the data line 114 is shortened with an increase of the number of data lines 114.

In the point-sequential method, with the progress of the high definition, since the time when image signals are sampled to the data lines 114 is not sufficiently secured, an electro-optical panel 100 is driven by a so-called phase expansion driving method. In the phase expansion driving method, the data lines 114 are divided into a plurality of blocks each composed of predetermined data lines (in this case, six data lines). In addition, image signals are distributed into six channels (phases) corresponding to the number of data line 114 included in one block and extend six times along a time axis, so that the distributed image signals are supplied to image signal lines 171 as image signals Vid1 to Vid6.

Meanwhile, in FIG. 5, a drain of an N-channel TFT 151, serving as a sampling switch, is connected to one end of the leftmost data line 114 among six data lines 114 belonging to an i-th column block (where i is one of integers 1, 2, . . . , n) from the left side, and a source thereof is connected to the image signal line 171 to which the image signal Vid1 is supplied. Similarly, a drain of the corresponding TFT 151 is connected to one end of each of the second column, third column, . . . , sixth column data lines 114 in the i-th block from the left side, and a source thereof is connected to each of the image signal lines 171 to which the image signals Vid2, Vid3, . . . , Vid6 are respectively supplied.

Further, in the structure shown in FIG. 5, when the total number of the scanning lines 112 is 'm' and the total number of the data line 114 is '6n' (where m and n both are integers), pixels are arranged in a matrix of m rows by 6n columns corresponding to intersections of the scanning lines 112 and the data lines 114.

Furthermore, as described below, the image signals Vid1 to Vid6 may be called channels ch1 to ch6. In this case, since the data line 114 belonging to a block corresponds to any one of seven image signal lines 171, for example, the leftmost data line 114 in a certain block correspond to the channel ch1.

Next, as shown in FIG. 6, a scanning line driving circuit 130 shifts a start pulse DY supplied at the beginning of the vertical scanning period according to a clock signal CLY to output scanning signals G1, G2, G3, . . . , Gm which sequentially exclusively turn to H levels. In addition, as shown in FIG. 6, a shift register 140 shifts a start pulse DX supplied at the beginning of the horizontal scanning period according to a clock signal CLX to output sampling signals S1, S2, S3, . . . , Sn which sequentially exclusively turn to H levels. Further, the pulse width of each of the sampling signals S1, S2, S3, . . . , Sn which turn to the H levels is narrowed up to a period Smp in which the pulse width is narrower than a half the period of the clock signal CLX such that adjacent sampling signals do not overlap each other.

In the phase expansion driving method, the respective blocks are selected one by one in one horizontal scanning period by the sampling signals S1, S2, S3, . . . , Sn. Here, for example, when an i-th block is selected and a sampling signal Si becomes an H level, six TFTs 151 whose drains are connected to the data lines 114 belonging to the block are simultaneously turned on. Therefore, the image signals Vid1, Vid2, Vid3, . . . , Vid6 are sampled to the first column, second column, third column, . . . , sixth column data lines 114 belonging to the block, respectively, and are then written on pixel electrodes 108 of the pixels corresponding to the intersections of the selected scanning line and the six data lines belonging to the i-th block, respectively.

In the phase expansion driving method, the time required for sampling can be lengthened six times longer than the structure in which the data lines 114 are selected one by one, to sample the image signals. Therefore, as described above, this method is suitable for addressing or achieving a high-definition display. In addition, here, the number of data lines belonging to one block is '6', but the number of data lines is not limited thereto.

However, in the phase expansion driving method, a plurality of data lines 114 divided into blocks each composed of predetermined data lines are driven, which causes a phenomenon (block ghost) in which display contents of a certain block displayed on pixels in an adjacent block, overlapped with the display contents of the adjacent block. The inventors suggested a technique in which the correction amount of the grayscale of pixels belonging to a target block is calculated based on the average variation of pixels belonging to the block positioned one block ahead of the target block, and in which the correction amount is added to image data to be supplied to the pixels belonging to the target block to remove the block ghost. See related art document Japanese Unexamined Patent Application Publication No. 2002-149136.

However, according the technique described in related art document Japanese Unexamined Patent Application Publication No. 2002-149136, the block ghost is suppressed to some degree, but the block ghost as much as can be viewed, still occurs. Exemplary embodiments of the present invention are designed to address or solve the above-mentioned and/or other problems. It is an object of exemplary embodiments of the invention to provide an image signal correcting method, a correcting circuit, and an electro-optical device, capable of reducing or preventing the generation of the block ghost and of displaying a high-quality image, and to provide an electronic apparatus having the electro-optical device as a display unit.

SUMMARY

In order to address or achieve the above-mentioned and/or other objects, exemplary embodiments of the present invention provide a image signal correcting method used for an electro-optical panel. The electro-optical panel includes a plurality of scanning lines; a plurality of data lines divided into groups each composed of predetermined data lines; image signal lines provided corresponding to the respective data lines in each block; sampling switches which are interposed between the data lines and the image signal lines corresponding to the data lines as electrical switches and are turned on when blocks are selected one by one in a period in which one scanning line is selected to sample image signals supplied to the image signal lines to the data lines belonging to one block; pixels which are provided corresponding to intersections of the plurality of scanning lines and the plurality of data lines and to which the sampled image signals are supplied through the data lines when the scanning line is selected. The image signal correcting method corrects the image signals according to the gray scale of the pixels provided corresponding to the intersections of the selected scanning line and the data lines belonging to the selected block to supply the corrected image signals through the image signal lines. The image signal correcting method includes calculating the variations between the gray-scale levels of the pixels provided corresponding to the intersections of the selected scanning line and the data lines belonging to the block selected one timing before the selection timing of the selected block and the gray-scale levels of the pixels provided corresponding to the intersections of the selected scanning line and the data lines belonging to the block selected at the selection timing and of calculating an average value of the variations, which is a first average value; calculating the variations between the gray-scale levels of the pixels provided corresponding to the intersections of the selected scanning line and the data lines belonging to the block selected two timings before the selection timing and the gray-scale levels of the pixels provided corresponding to the intersections of the selected scanning line and the data lines belonging to the block selected one timing before the selection timing and of calculating an average value of the variations, which is a second average value; calculating correction data based on at least the first and second average values; and adding the correction data to the image signals of the pixels provided corresponding to the intersections of the selected scanning line and the data lines belonging to the selected block. According to this method, the correction data is calculated based on the variation between the currently selected block and a block selected in a position one block ahead of the currently selected block and the variation between the block selected in a position two blocks ahead of the currently selected block and the block selected one block ahead thereof. The correction data is then added to the image signals of the pixels provided corresponding to the intersections of the selected scanning line and the data lines belonging to the selected block, which makes it possible to more reliably reduce or prevent the generation of a block ghost and to perform high-quality display.

Further, the conception of exemplary embodiments of the present invention can also be applied to a correcting circuit and an electro-optical device, in addition to the image signal correcting method. Furthermore, an electronic apparatus according to exemplary embodiments of the present invention can use the electro-optical device as a display unit, which makes it possible to more reliably reduce or prevent the generation of the block ghost.

DETAILED DESCRIPTION OF EMBODIMENTS

Hereinafter, preferred exemplary embodiments of the present invention will be described with reference to the accompanying drawings.

1. First Exemplary Embodiment

Figure 1:
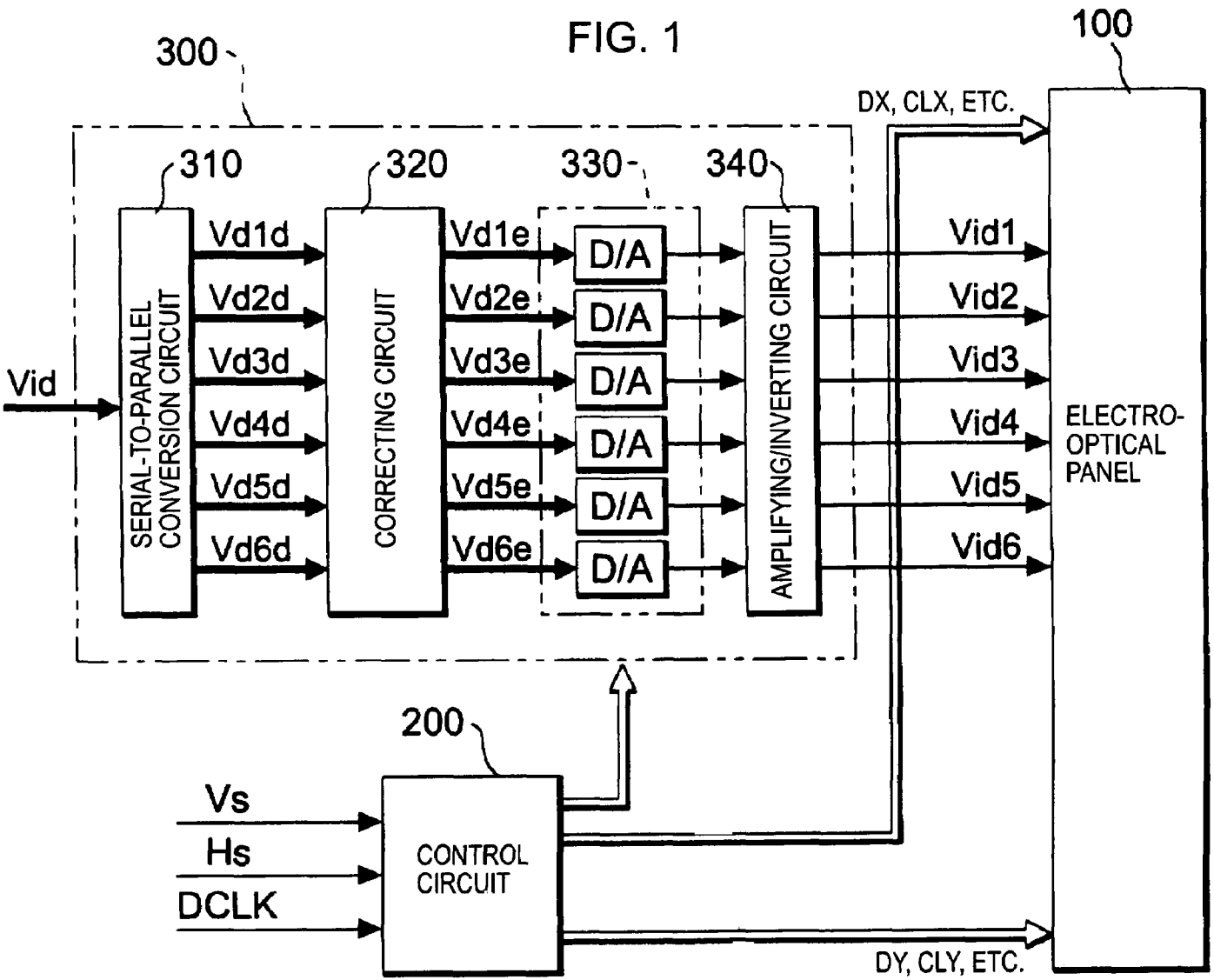
FIG. 1 is a schematic showing the structure of an electro-optical device according to an exemplary embodiment of the present invention.

FIG. 1 is a schematic showing the overall structure of an electro-optical device equipped with a correcting circuit according to a first exemplary embodiment of the present invention.

Figure 5:
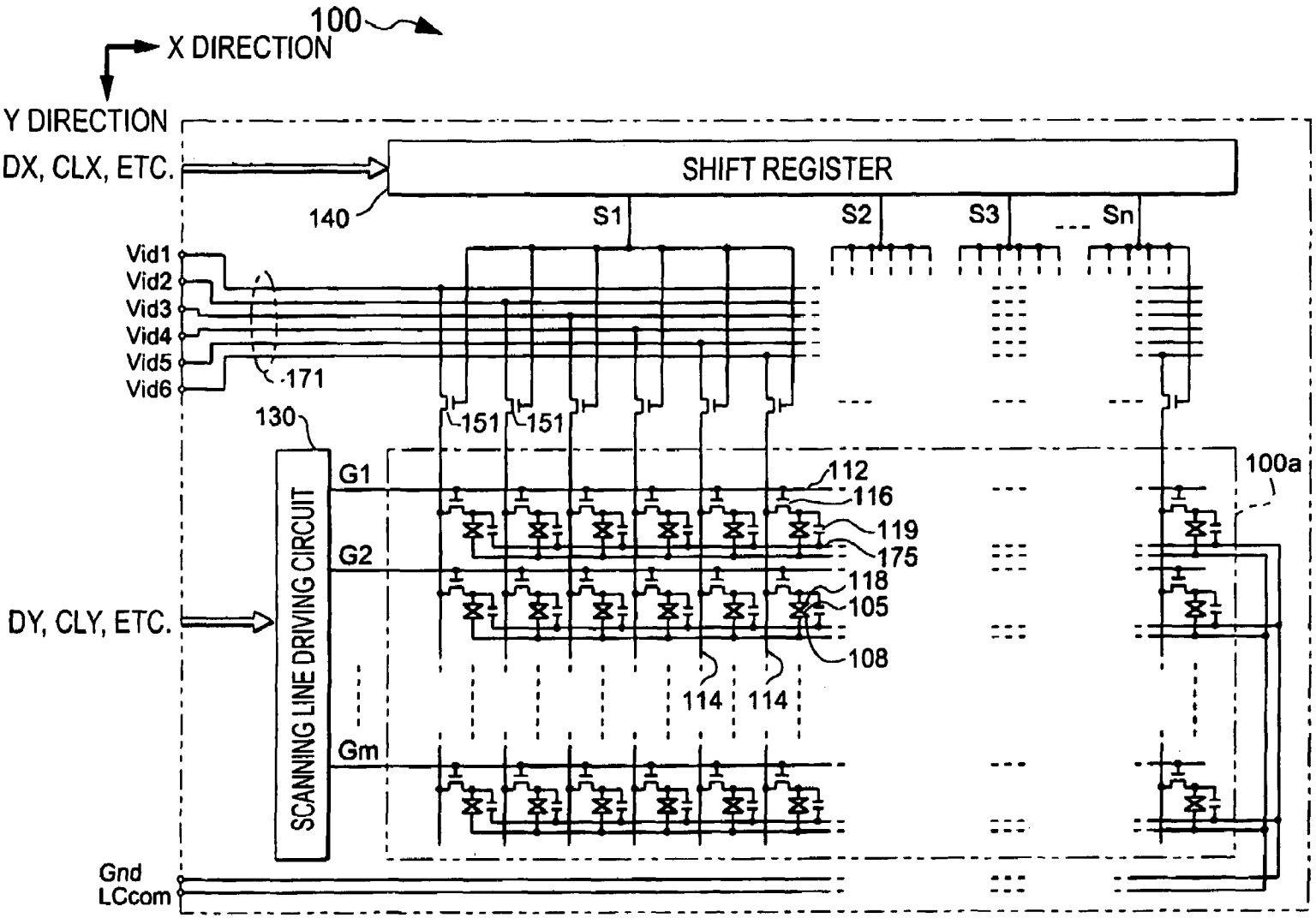
FIG. 5 is a schematic showing the structure of an electro-optical panel driven by a phase expansion driving method.
Figure 6:
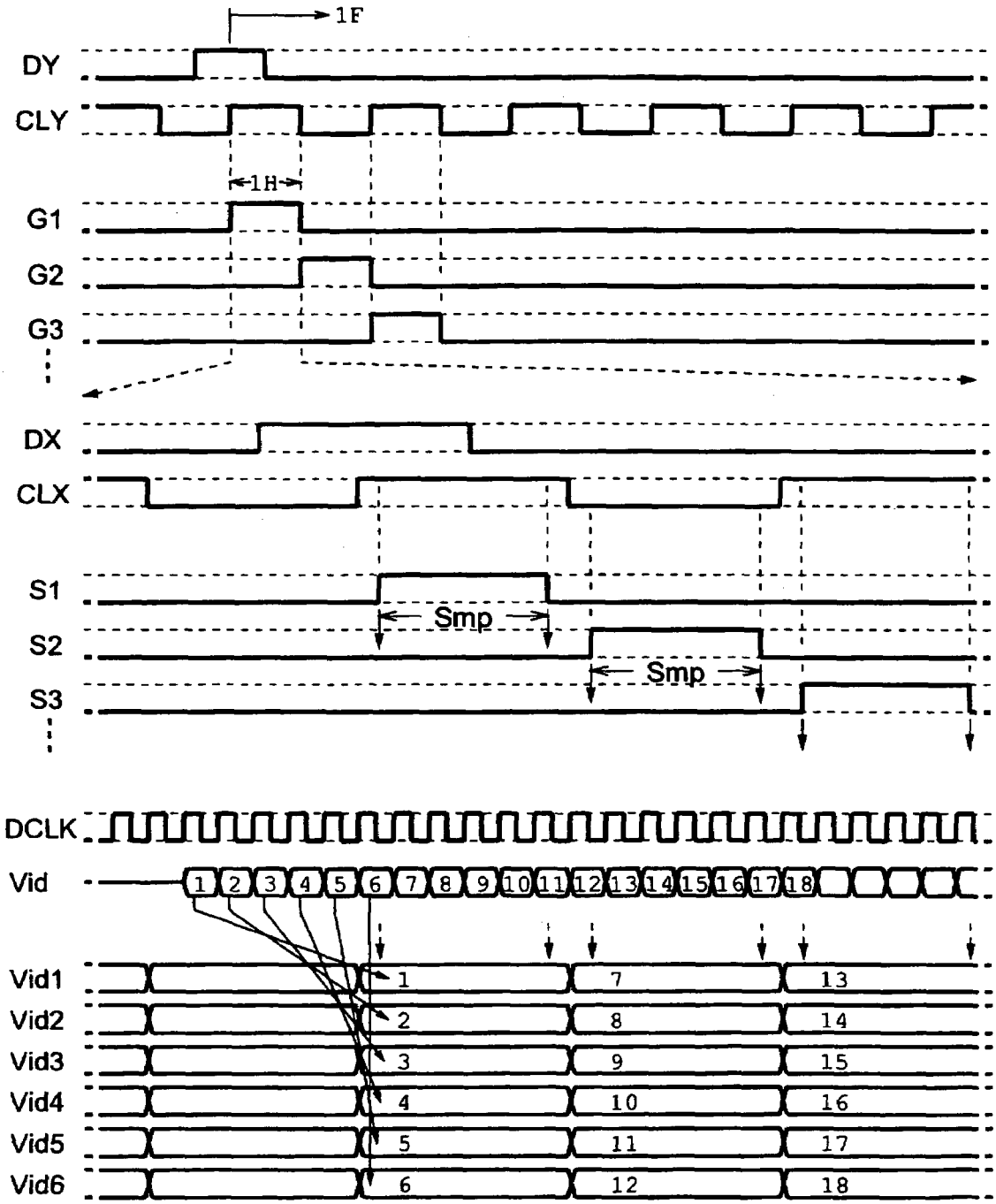
FIG. 6 is a schematic showing the operation of the electro-optical device driven by the phase expansion driving method.

As shown in FIG. 1, the electro-optical device includes an electro-optical panel 100, a control circuit 200, a processing circuit 300, etc. Among them, the electro-optical panel 100 has the same structure as that shown in FIG. 5, and thus a detailed description thereof will be omitted.

The control circuit 200 generates timing signals and clock signals for controlling each units, based on vertical scanning signals Vs, horizontal scanning signals Hs, and dot clock signals DCLK supplied from a host device (not shown).

The processing circuit 300 includes a S/P conversion circuit 310, a correcting circuit 320, a D/A converter group 330, and an amplifying/inverting circuit 340.

Among them, the S/P conversion circuit 310 distributes image data Vid to N channels (N is 6 in FIG. 1) and extends them N times on a time axis (serial-to-parallel conversion) to output the extended data as image data Vd1*d* to Vd6*d*. The image data Vid is serially supplied from a host device (not shown) in synchronism with the vertical scanning signals Vs, the horizontal scanning signals Hs, and the dot clock signals DCLK to specify the gray-scale level (brightness) for every pixel with a digital value. In addition, the serial-to-parallel conversion is performed in order to extend the time when the image signal is applied to secure a sample and hold time and a charging/discharging time in the sampling switch 151 (see FIG. 5), as described above.

The correcting circuit 320 corrects the image data Vd1*d* to Vd6*d* to output the corrected image data as image data Vd1*e* to Vd6*e*. In addition, the correcting circuit 320 will be described later in detail.

The D/A converter group 330 consists of D/A converters respectively provided for channels, and converts the corrected image data Vd1*e* to Vd6*e* into analog image signals having voltages corresponding to the gray-scale levels of pixels, respectively.

The amplifying and inverting circuit 340 inverts the polarities of the analog-converted image signals or returns them to the previous states and then properly amplifies them to supply the amplified signals as image signals Vid1 to Vid6. In this case, the polarity inversion may be performed for (1) every scanning line, (2) every data line, (3) every pixel, or (4) every surface (frame). In the present exemplary embodiment, for the convenience of explanation, the polarity inversion is performed on the unit of scanning lines. However, exemplary embodiments of the present invention are not limited thereto. In addition, the polarity inversion in the invention means a process for alternately inverting the levels of a voltage based on a predetermined voltage (which is an intermediate potential of the amplitude of an image signal and is substantially equal to a voltage LCcom applied to a counter electrode). Further, a voltage higher than the intermediate potential of the amplitude is referred to as a positive polarity, and a voltage lower than that is referred to as a negative polarity.

Figure 2:
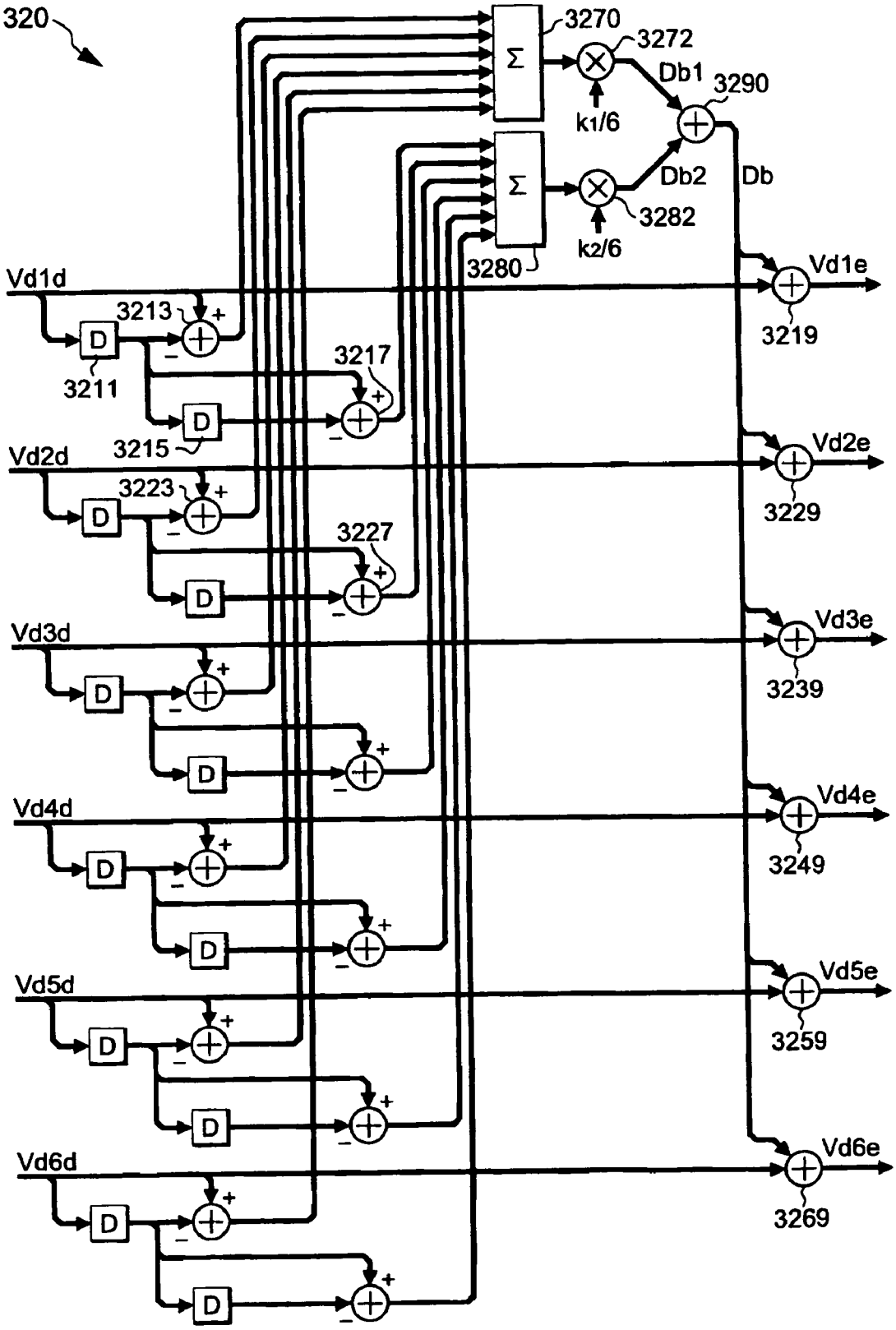
FIG. 2 is a schematic showing the structure of a correcting circuit of the electro-optical device.

FIG. 2 is a schematic showing the detailed structure of the correcting circuit 320, which is a feature portion of exemplary embodiments of the invention. In addition, for the convenience of explanation, a sequence of processing the image data Vd1*d* of a channel ch1 will be described.

As shown in FIG. 2, the image data Vd1*d* of the channel ch1 is input to an input terminal of a delay circuit 3211, an addition input terminal of an adder 3213, and an addition input terminal of an adder 3219, respectively. The delay circuit 3211 functions to delay the image data Vd1*d* by one block of selection time, and the delayed data is input to a subtraction input terminal of an adder 3213, an input terminal of a delay circuit 3215, and an addition input terminal of an adder 3217, respectively. In addition, the one block of selection time referred to in the present exemplary embodiment is a period of time when sampling signals sequentially turn to H levels. In the present exemplary embodiment, the one block of selection time is six times the period of time when the image data Vid corresponding to one pixel is supplied before development.

The delay circuit 3215 delays the input data by one block of selection time, similar to the delay circuit 3211, and the delayed data is input to a subtraction input terminal of an adder 3217.

Figure 3:
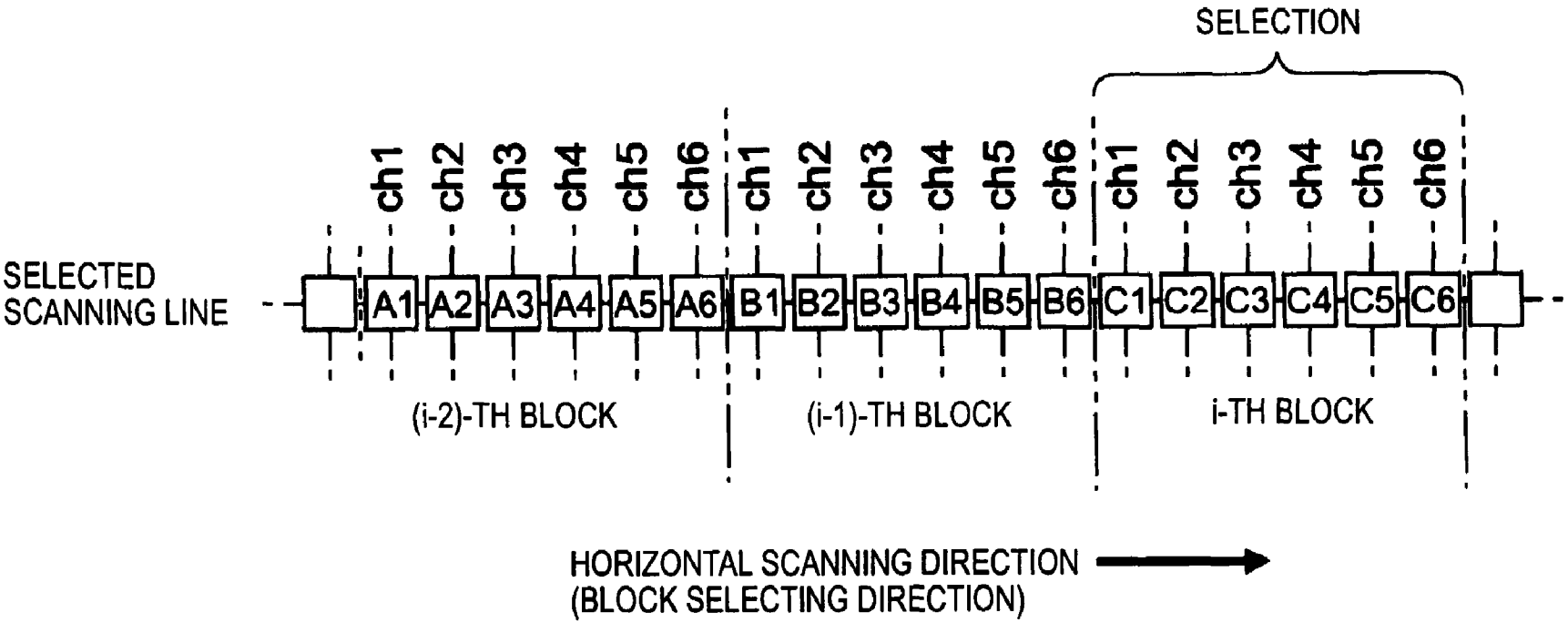
FIG. 3 is a schematic showing the correcting circuit.

The adder 3213 subtracts delay data by the delay circuit 3211 from the image data Vd1*d*, and supplies the subtracted result to an input terminal of a summing circuit 3270. For example, as shown in FIG. 3, at this point in time, when an i-th block is selected, the image data Vd1*d* specifies the gray-scale level of a pixel C1 corresponding to an intersection of the selected scanning line and the leftmost data line of the i-th block corresponding to the channel ch1. Therefore, the output of the adder 3213 corresponds to a gray-scale variation from a pixel B1 corresponding to an intersection of the selected scanning line and the leftmost data line of an (I−1)-th block selected in a position one block ahead of the i-th block to a pixel C1 of the block selected at this point in time. That is, the output of the adder 3213 corresponds to a voltage variation of an image signal line 171 of the channel ch1 when block selection is performed from the (i−1)-th block to the i-th block at this point in time.

The adder 3217 subtracts the delay data by the delay circuit 3215 from the delay data by the delay circuit 3211 and supplies the subtracted result to an input terminal of a summing circuit 3280. The delay data by the delay circuit 3215 further delays the delay data by the delay circuit 3211 by the selection time corresponding to one block. Therefore, as shown in FIG. 3, the output of the adder 3217 corresponds to a gray-scale variation from a pixel A1 corresponding to an intersection of the selected scanning line and the leftmost data line of an (i−2)-th block selected in a position two blocks before the i-th block to the pixel B1 of the (i−1)-th block. That is, the output of the adder 3217 corresponds to a voltage variation of the image signal line 171 of the channel ch1 when block selection is performed from the (i−1)-th block to the (i−2)-th block.

Also, a sequence of processing a channel ch2 is performed similar to the sequence of processing the channel ch1. That is, the image data Vd2*d* is supplied to an addition input terminal of an adder 3229, and a gray-scale variation from the pixel B2 to a pixel C2 is supplied to an input terminal of the summing circuit 3270 as the subtraction result by an adder 3223. In addition, a gray-scale variation from a pixel A2 to the pixel B2 is supplied to an input terminal of a summing circuit 3280 as the subtraction result by an adder 3227.

The same processing sequence is performed on other channels ch3 to ch6. That is, the image data Vd3*d* to Vd6*d* are supplied to addition input terminals of adders 3239, 3249, 3259, and 3269, respectively. When block selection is changed from the block in the previous stage to the current block, the gray-scale variations among the same channels are supplied to the summing circuit 3270, respectively. In addition, when the block selection is changed from the block in two previous stages to the block in the previous stage, the gray-scale variations among the same channels are supplied to the summing circuit 3280, respectively.

The summing circuit 3270 calculates the sum of the gray-scale variations supplied to the respective input terminals thereof, that is, the sum of the voltage variations of the respective image signal lines 171, and then supplies the sum to an input terminal of a multiplier 3272. The multiplier 3272 multiplies the sum of the gray-scale variations by a coefficient '$k_1/6$' to output data Db1. Here, a coefficient '1/6' of the coefficient '$k_1/6$' is used for calculating the average value of the channels ch1 to ch6. Therefore, the data Db1 is obtained by multiplying the average value of image gray-scale variations extending from the block in the previous stage to the selected block by a coefficient '$k_1$'. That is, the average value of the image gray-scale variations (the average value of voltage variations of the respective image signal lines 171) is reflected in the data Db1.

Similarly, the summing circuit 3280 calculates the sum of the gray-scale variations supplied to the respective input terminals and then supplies the sum to an input terminal of a multiplier 3282. Then, the multiplier 3282 multiplies the sum of the gray-scale variations by a coefficient '$k_2/6$' to output data Db2. Therefore, the data Db2 is obtained by multiplying the average value of the image gray-scale variations extending from the block in two previous stages of the selected block to the block in the previous stage thereof by a coefficient '$k_2$'.

Further, an adder (a calculating circuit) 3290 adds the data Db1 and the data Db2 and outputs the added result as correction data Db. Here, the correction data Db is obtained by dividing, at a ratio of $k_1$ to $k_2$, the value in which the average value of the image gray-scale variations extending from the block in the previous stage to the selected block is reflected and the value in which the average value of the image gray-scale variations extending from the block in two previous stages of the selected block to the block in the previous stage of the selected block is reflected.

Furthermore, in the present exemplary embodiment, the coefficients $k_1$ and $k_2$ are set to satisfy the relationship $k_1>k_2$Therefore, in the correction data Db, the data Db1 has a larger percentage of occupation than the data Db2. The reason why the coefficients are set to respectively have small and large values is that, when the gray-scale levels of the pixels in the selected block vary, the data Db1, which is the average variation nearest positioned in terms of time, is more greatly affected than the data Db2, which is the average variation furthest positioned in terms of time.

That is, the correction data Db is a value obtained by more largely weighting the average value of the voltage variations of the image signal lines 171 when the block selection is changed from the block in the previous stage to the current block than the average value of the voltage variations of the image signal lines 171 when the block selection is changed from the block in two previous stages to the block in the previous stage and by adding the average values.

The correction data Db is supplied to the other side of the addition input terminals of each of the adders (adding circuit) 3219, 3229, 3239, 3249, 3259, and 3269. Then, the results added by the adders are output as the corrected data Vd1*e* to Vd6*e*, respectively.

As described in related art document Japanese Unexamined Patent Application Publication No. 2002-149136, the block ghost is generated due to two causes. A first cause is that the voltage of the counter electrode 108 to be constant is changed according to the voltage variation of the image signal line 171 due to the capacitive coupling of the image signal line 171 and the counter electrode 108 and the low resistance of the counter electrode 108. A second cause is that, when a certain block is selected, the voltage of the counter electrode 108 varies according to the charging/discharging of electric charges.

In all cases, the above-mentioned related art document Japanese Unexamined Patent Application Publication No. 2002-149136 discloses a structure in which the voltage variation of the counter electrode 108 is attenuated to the voltage LCcom in a short period of time. Therefore, only the voltage variation (grayscale variation) from the previous block to the selected block is considered in related art document Japanese Unexamined Patent Application Publication No. 2002-149136.

On the other hand, in the present exemplary embodiment, correction data is calculated, cumulatively considering the voltage variation when the current block is selected as well as the voltage variation (grayscale variation) when the immediately previous block is selected. The calculated correction data is respectively added to the image data Vd1*d* to Vd6*d* of the respective channels. In this way, the voltage applied to the pixel electrodes 118 is corrected without being influenced by the voltage variation of the counter electrode 108. Therefore, the present exemplary embodiment makes it possible to more effectively suppress the block ghost.

2. Second Exemplary Embodiment

In addition to the aspect of the first exemplary embodiment, it may be considered the voltage variation (grayscale variation when the block in two previous stages is selected, or the voltage variation (grayscale variation) when blocks other than that are selected.

Further, as seen from the applying point of the voltage LCcom, when resistance values of the counter electrode 108 are different from each other at the right side and the left side in a display region, the coefficients $k_1$ and $k_2$ may vary as the block to be selected proceeds from the left side to the right side.

Furthermore, as will be described later, even when horizontal scanning is performed from the right to the left in order to form a mirror reversed image, similarly, the coefficients $k_1$ and $k_2$ may vary according to the horizontal position of the block to be selected.

Moreover, in the above-mentioned first exemplary embodiment, the image signals Vid1 to Vid6 converted into six channels are sampled with respect to the six data lines 114 integrated into one. However, the number of channels and the number of data lines (that is, the number of data lines integrated into one) to which the image signals are simultaneously applied are not limited to '6', and the number may be '2' or more. For example, the number of channels and the number of data lines to which the image signals are simultaneously applied may be '3', '12', or '24', and correction image signals divided into 3, 12, or 24 channels may be supplied to the 3, 12, or 24 data lines, respectively. In addition, since a color image signal is composed of signals corresponding to the three primary colors, the number of channels is preferably a multiple of three in order to reduce the size of the circuit and to easily perform control. However, when used for the purpose of simple light modulation as in a projector, which will be described later, the number is not necessarily a multiple of three.

Meanwhile, in the above-mentioned exemplary embodiment, the processing circuit 300 processes the digital image signal Vid, but may process analog image signals. In addition, in the above-mentioned exemplary embodiment, when the voltage effective value between the counter electrode 108 and the pixel electrode 118 is small, the normally white mode for performing white display is taken as an example. However, in that case, a normally black mode for performing black display may be used.

Further, in the above-mentioned exemplary embodiment, TN type liquid crystal is used. However, liquid crystal of a bi-stability type having a memory property, such as a bistable twisted nematic (BTN) type or a ferroelectric type, a polymer dispersed type, or a GH (guest host) type in which dye molecules and crystal molecules are arranged in parallel to each other by dissolving the dye (guest) having anisotropy in the absorption of visible light in the longitudinal direction and latitudinal direction of the molecules in the liquid crystal (host) having a predetermined molecule arrangement.

Also, the liquid crystal may have a vertical alignment structure (homeotropic alignment) in which liquid crystal molecules are vertically aligned with respect to both substrates when no voltage is applied. However, the liquid crystal molecules are horizontally aligned with respect to both the substrates when a voltage is applied, or may have a parallel (horizontal) alignment (homogeneous alignment) in which the liquid crystal molecules are horizontally aligned with respect to both the substrates when no voltage is applied, but the liquid crystal molecules are vertically aligned with respect to both the substrates when a voltage is applied. In this way, in exemplary embodiments of the present invention, various types of liquid crystal and alignment methods can be used.

In the above-mentioned exemplary embodiments, the liquid crystal display device is taken as an example. However, exemplary embodiments of the present invention can be applied to apparatuses using an electro-luminescent (EL) device, an electron emission device, an electrophoresis device, a digital mirror device, etc., and plasma display devices if the apparatuses are structured such that each block is composed of a predetermined number of data lines, and the image signals supplied to the image signal lines corresponding to the respective data lines belonging to the selected block are sampled.

3. Applications

Electronic Apparatus

Next, as an example of an electronic apparatus using the electro-optical device according to the above-mentioned exemplary embodiment, a projector using the electro-optical panel 100 as a light valve will be described below.

Figure 4:
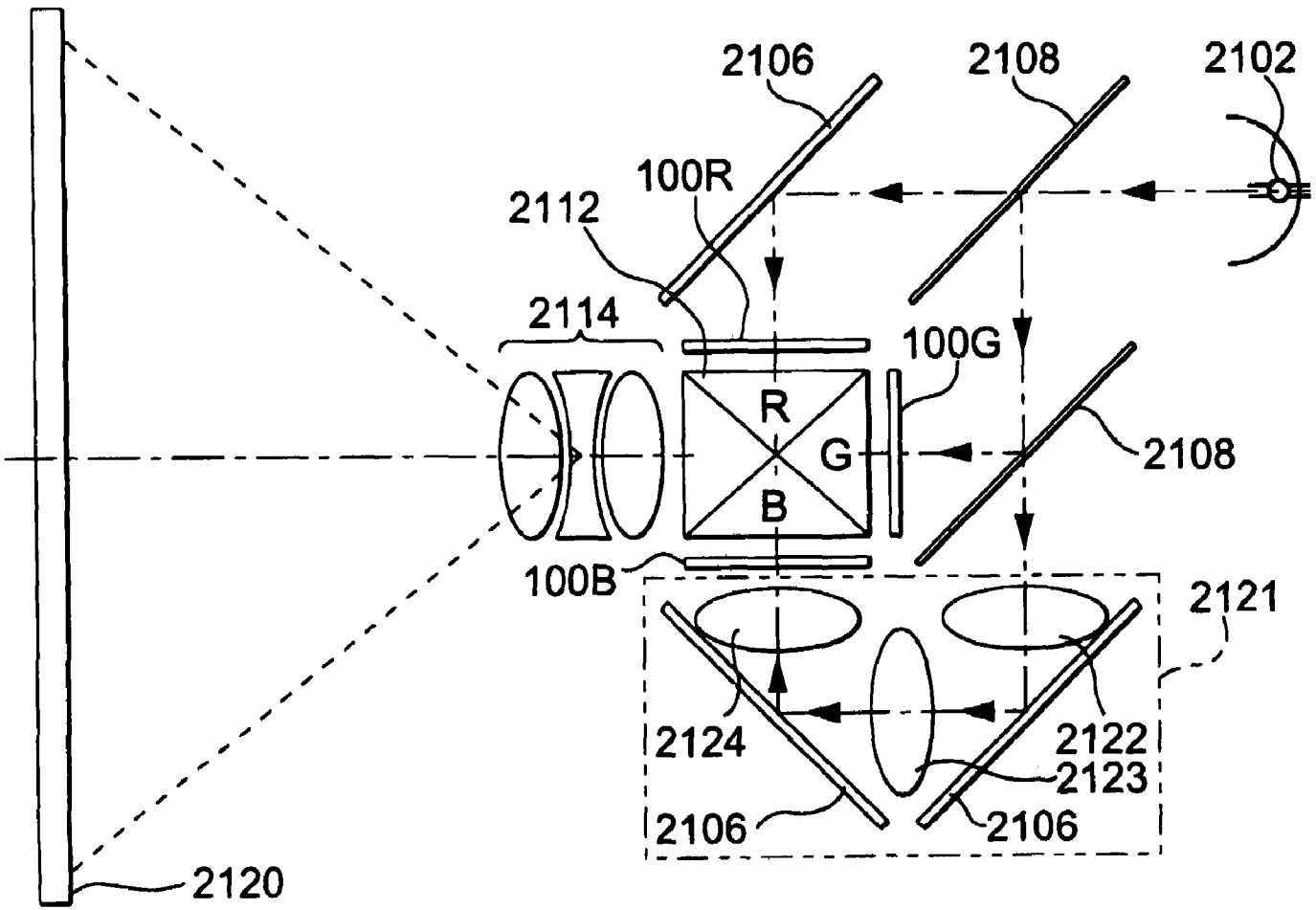
FIG. 4 is a schematic showing the structure of a projector, which is an example of an electronic apparatus equipped with the electro-optical device according to the exemplary embodiment of the present invention.

FIG. 4 is a schematic showing the structure of the projector. As shown in FIG. 4, a projector 2100 is provided with a lamp unit 2102 having a white light source, such as a halogen lamp therein. Projection light emitted from the lamp unit 2102 is divided into three primary color beams R (red), G (green), and B (blue) by three mirrors 2106 and two dichroic mirrors 2108 that are provided therein. The three primary color beams are introduced into light valves 100R, 100G, and 100B respectively corresponding to the three primary color beams. Since the B light beam has an optical path longer than those of the R light beam and the G light beam, the B light beam is introduced via a relay lens system 2121 including an incident lens 2122, a relay lens 2123, and an emission lens 2124 in this order to reduce or prevent the optical loss thereof.

Here, the light valves 100R, 100G, and 100B have the same structure as that of the electro-optical panel 100 in accordance with the above-mentioned exemplary embodiments, and are driven by the image signals respectively corresponding to R, G, and B supplied from the processing circuit (not shown in FIG. 4).

Light beams modulated by the light valves 100R, 100G, and 100B are incident on a dichroic prism 2112 from the three directions. The R light beam and the B light beam are reflected at an angle of 90° by the dichroic prism 2112, but the G light beam passes therethrough. After a color image is synthesized from these color light beams, the color image is projected onto a screen 2120 through a projection lens 2114.

Since the R, G, and B light beams are incident on the light valves 100R, 100G, and 100B through the dichroic mirrors 2108, respectively, it is not necessary to provide color filters. The images transmitted from the light valves 100R and 100B are reflected by the dichroic mirror 2112 and are then projected, but the image transmitted from the light valve 100G is directly projected. Thus, he horizontal scanning direction by the light valves 100R and 100B is opposite to the horizontal direction by the light valve 100G, thereby displaying a mirror-reversed image.

In addition to the electronic apparatus described referring to FIG. 4, exemplary embodiments of the present invention can be applied to for example, mobile phones, personal computers, televisions, video cameras, car navigation apparatuses, pagers, electronic organizers, electronic calculators, word processors, workstations, TV telephones, POS terminals, digital still cameras, and apparatuses equipped with touch panels. Of course, the electro-optical device according to exemplary embodiments of the present invention can be applied to these electronic apparatuses.

The invention claimed is:

1. An image signal correcting method for use with an electro-optical panel that includes a plurality of scanning lines;

a plurality of data lines; and pixels which are provided corresponding to intersections of the plurality of scanning lines and the plurality of data lines and to which the image signals are supplied through the data lines, the electro-optical panel being driven such that, in a period of time when the scanning lines are selected, blocks, each of which are composed of predetermined data lines, are sequentially selected, the image signal correcting method, comprising:

calculating variations between grayscales of the image signals respectively supplied to the predetermined data lines belonging to a first block and grayscales of the image signals respectively supplied to the predetermined data lines belonging to a second block selected in a position one block ahead of the first block;

calculating an average value of the variations, which is a first average value;

calculating variations between grayscales of the image signals respectively supplied to the predetermined data lines belonging to a third block selected in a position two blocks ahead of the first block and grayscales of the image signals respectively supplied to the predetermined data lines belonging to the second block;

calculating an average value of the variations, which is a second average value;

calculating correction data based on the first and second average values; and correcting the image signals respectively supplied to the data lines belonging to the first selected block using the correction data.

2. An image signal correcting circuit for use with an electro-optical panel that includes a plurality of scanning lines;

a plurality of data lines, and pixels which are provided corresponding to intersections of the plurality of scanning lines and the plurality of data lines and to which the image signals are supplied through the data lines, the electro-optical panel being driven such that, in a period of time when the scanning lines are selected, blocks each of which are composed of predetermined data lines, are sequentially selected;

a first averaging circuit to calculate variations between grayscales of the image signals respectively supplied to the predetermined data lines belonging to a first block and grayscales of the image signals respectively supplied to the predetermined data lines belonging to a second block selected in a position one block ahead of the first block to calculate an average value of the variations, which is a first average value;

a second averaging circuit to calculate variations between grayscales of the image signals respectively supplied to the predetermined data lines belonging to a third block selected in a position two blocks ahead of the first block and the grayscales of the image signals respectively supplied to the predetermined data lines belonging to the second block to calculate an average value of the variations, which is a second average value;

a calculating circuit to calculate correction data based on the first and second average values; and a correcting circuit to correct the image signals respectively supplied to the data lines belonging to the first selected block using the correction data.

3. The image signal correcting circuit according to claim 2, further comprising:

first delay circuits to delay the image signals to output them as image signals corresponding to the second block.

4. The image signal correcting circuit according to claim 2, further comprising:

second delay circuits to delay the image signals to output them as image signals corresponding to the third block.

5. The image signal correcting circuit according to claim 4, each of the second delay circuits receiving the signals output from the first delay circuit to delay the signals.

6. The image signal correcting circuit according to claim 5, the first and second delay circuits delaying the image signals by the time corresponding to the period where one of the blocks is selected.

7. The image signal correcting circuit according to claim 2, further comprising:

a first multiplier to multiply the first average value by a first coefficient; and a second multiplier to multiply the second average value by a second coefficient.

8. The image signal correcting circuit according to claim 2, further comprising:

an adder to add output of the first multiplier and output of the second multiplier.

9. The image signal correcting circuit according to claim 7, the value of the first coefficient being larger than that of the second coefficient.

10. An electro-optical device comprising an electro-optical panel, that includes:

a plurality of scanning lines;

a plurality of data lines; and pixels which are provided corresponding to intersections of the plurality of scanning lines and the plurality of data lines and to which the image signals are supplied through the data lines, the electro-optical panel being driven such that, in a period of time when the scanning lines are selected, blocks each composed of predetermined data lines are sequentially selected, the electro-optical device, comprising:

a first averaging circuit to calculate variations between grayscales of the image signals respectively supplied to the predetermined data lines belonging to a first block and grayscales of the image signals respectively supplied to the predetermined data lines belonging to a second block selected in a position one block ahead of the first block to calculate an average value of the variations, which is a first average value;

a second averaging circuit to calculate variations between grayscales of the image signals respectively supplied to the predetermined data lines belonging to a third block selected in a position two blocks ahead of the first block and the grayscales of the image signals respectively supplied to the predetermined data lines belonging to the second block to calculate an average value of the variations, which is a second average value;

a calculating circuit to calculate correction data based on the first and second average values; and a correcting circuit to correct the image signals respectively supplied to the data lines belonging to the first selected block using the correction data.

11. An electronic apparatus, comprising:

the electro-optical device according to claim 10.

* * * * *

UNITED STATES PATENT AND TRADEMARK OFFICE

CERTIFICATE OF CORRECTION

PATENT NO. : 7,602,359 B2
APPLICATION NO. : 11/041259
DATED : October 13, 2009
INVENTOR(S) : Toru Aoki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1298 days.

Signed and Sealed this

Fifth Day of October, 2010

David J. Kappos

David J. Kappos
*Director of the United States Patent and Trademark Office*